United States Patent [19]

Michelfelder et al.

[11] 4,333,405

[45] Jun. 8, 1982

[54] BURNER FOR COMBUSTION OF POWDERED FUELS

[75] Inventors: Sigfrid Michelfelder; Klaus Leikert, both of Gummersbach, Fed. Rep. of Germany

[73] Assignee: L. & C. Steinmüller GmbH, Gummersbach, Fed. Rep. of Germany

[21] Appl. No.: 176,188

[22] Filed: Aug. 7, 1980

[30] Foreign Application Priority Data

Aug. 16, 1979 [DE] Fed. Rep. of Germany ..... 2933060

[51] Int. Cl.[3] ..... F23D 1/02

[52] U.S. Cl. ..... 110/264; 110/265; 110/347; 431/183; 431/184

[58] Field of Search ..... 110/263, 264, 265, 347; 431/2, 8, 9, 182, 183, 184; 239/399, 400, 402.5

[56] References Cited

U.S. PATENT DOCUMENTS 4,147,116 4/1979 Graybill ..... 110/263
4,221,174 9/1980 Smith et al. ..... 110/263 X
4,228,747 10/1980 Smirlock et al. ..... 110/347
4,241,673 12/1980 Smith et al. ..... 110/264 X

*Primary Examiner*—Edward G. Favors
*Attorney, Agent, or Firm*—Becker & Becker, Inc.

[57] ABSTRACT

A burner for combustion of powdery fuels. The burner has a core-air tube with a centrically arranged ignition device, a dust tube surrounding the core-air tube, and a mantle-air tube which surrounds the dust tube and is provided with an axially displaceable twist blade ring or impeller, arranged at its air inlet, as well as a burner opening which widens conically toward the combustion chamber. A dust-ignition burner is arranged concentrically in a core-air tube, and comprises an ignition-dust tube arranged concentrically around an igniter, and a mantle-air tube which surrounds the ignition-dust tube for the ignition-dust flame and is provided with an axially displaceable twist blade ring or impeller, arranged at its air inlet, as well as a conically widening outlet. The conical angle of the dust-ignition burner outlet is equal to or greater than the conical angle of the outlet of the main burner. The dust-ignition burner outlet terminates before the beginning of the conical widening of the main burner.

10 Claims, 1 Drawing Figure

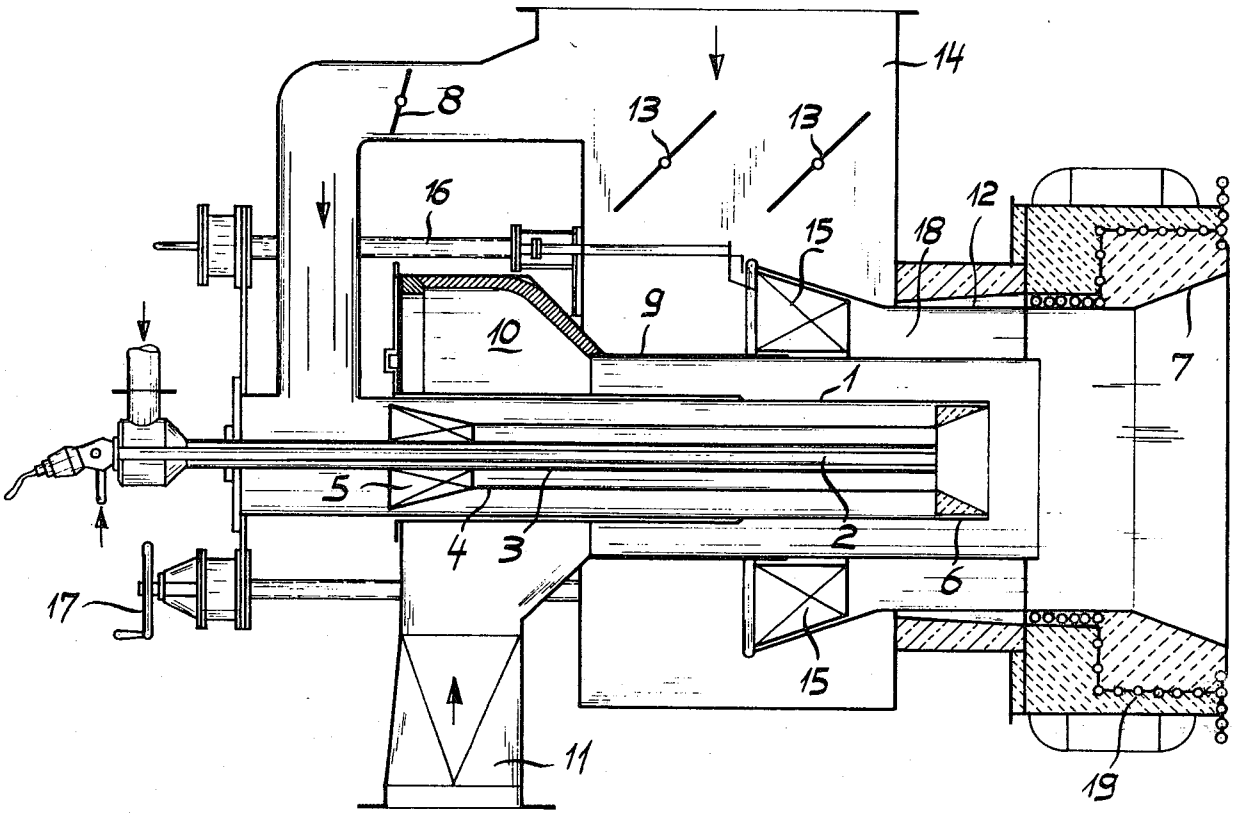
1
2
3
4
5
6
7
8
9
10
11
12
13
13
14
15
15
16
17
18
19

BURNER FOR COMBUSTION OF POWDERED FUELS

The present invention relates to a burner, for burning or combustion of powdered or finely divided fuels, which comprises a core-air tube with a centrically arranged ignition device, a dust tube which surrounds the core-air tube, and a mantle-air tube which surrounds the dust tube and is provided with an axially displaceable twist blade ring or impeller, arranged at its air inlet, as well as a burner opening or mouth which widens conically toward the combustion chamber.

Generally, ignition energy is supplied to the combustible fuel-air mixture for igniting the burner flame. With annular burners of the aforementioned type, the preparation and supply of the ignition energy is effected by so-called ignition burners which are operated with oil or gas. In such a case, the oil or the gas is ignited by means of an electric ignition spark. The utilization of oil or gas as ignition energy carriers is effected with a view to the ignition quality and combustion stability which is especially necessary with cold combustion chamber influences.

For reasons of cost and availability of reserves, it is increasingly desirable, in place of natural gas or crude oil as an ignition energy carrier, especially with coal dust firing, to utilize coal or another solid fuel as the ignition fuel.

It is therefore an object of the present invention to develop a burner for combustion of powdery or dust-like fuels according to which a solid fuel can be used as the ignition energy carrier.

This object, and other objects and advantages of the present invention, will appear more clearly from the following specification in connection with the accompanying drawing, which illustrates a coal dust annular burner having an inventive ignition burner arranged in the burner axis.

The burner of the present invention is characterized primarily in that a dust-ignition burner is concentrically arranged in the core-air tube, and comprises an ignition-dust tube arranged concentrically around an igniter, and a mantle-air tube which surrounds the ignition-dust tube for the ignition-dust flame and is provided with an axially displaceable twist blade ring or impeller, arranged at its air inlet, as well as a conically widening outlet or discharge.

In accordance with the teaching of the present invention, the conical angle of the dust-ignition burner discharge is equal to or greater than the conical angle of the discharge of the main burner.

Furthermore, in accordance with the teaching of the present invention, the dust-ignition burner discharge terminates before the beginning of the conical widening of the main burner.

For ignition of the ignition burner, according to a further concept of the present invention, the igniter can be operated gas-electrically, oil-electrically, or strictly electrically.

The mantle air for the dust-ignition burner, and the mantle air for the main burner, are supplied by separate channels or passages having control flaps or deflectors, whereby both air passages are in communication with the entire air passage of the main burner.

By means of the arrangement of the ignition burner in the core-air passage of the main burner, there is inventively attained that the mantle-air passage of the ignition burner simultaneously forms the core-air passage of the main burner.

If a dust flame, in relation to its ignition quality, evidences a more inactive or slower behavior than the previously utilized gas or oil flames, allowance can be made for this condition with an influencing measure on the ignition burner construction.

It has been found that the relative unwillingness of a dust-ignition flame to ignite, and the ignition difficulties connected therewith, can be obviated if the construction principle of the main burner is largely used as the basis for the ignition burner. In this connection, according to the present invention, the burning in the burner principle is expanded to apply to dust-dust flames in an annular burner.

The sole FIGURE, partly in section, shows the burner of the invention.

Referring now to the drawing in detail, the round or annular burner, which is operated with powdered coal or coal dust, comprises a central core-air tube 1 which is utilized for receiving the dust-ignition burner. The dust-ignition burner comprises an ignition-dust tube 3 which is arranged concentrically around an igniter tube 2. The ignition-dust tube 3 in turn comprises a mantle-air tube 4 having an axially displaceable twist blade ring or impeller 5 arranged at its air inlet as well as having a conically widening outlet or discharge 6. Regardless of the structural similarity of the ignition burner to the main burner, there are, however, procedurally-specific necessary structural and operating differences.

The structural differences consist in the configuration of the conical ignition burner discharge 6, the conical angle of which is generally greater than the conical angle of the main burner outlet or discharge 7. Furthermore, the ratio of the axial length of the outlet cone to the mantle-air tube diameter is greater (0.75 to 1.5) than the corresponding ratio of the main burner (0.4). Furthermore, with the ignition burner the core-air tube is lacking in view of the production of a rich, and accordingly more ignitable, dust-air mixture. A further structural difference consists in that the ignition-dust flame, after discharge from the burner cone or discharge 6, is, in contrast to the main burner flame, protected against excessive heat loss by the main burner cone 7, which has an advantageous effect upon the ignition quality and stability.

A procedurally-specific structural feature is also recognizable therein that the combustion air flow for the ignition-dust flame is supplied to the ignition burner by the core-air passage of the main burner, and is controllable by a separate control element independent of the mantle-air flow of the main burner.

The operational differences of the ignition burner compared with the main burner consist in that the dust air-dust weight ratio for enhancement of the ignition quality is selected considerably smaller (0.5 to 1.0) than with the main burner (1.5 to 2.0). Furthermore the dust-ignition flame is operated with a smaller air number ($\lambda=0.8$ to 1.1) than that of the main burner flame ($\lambda=1.1$ to 1.3), with the goal of maintaining the dust-air mixture for the ignition flame in a rich, and accordingly more ignitable, range. Furthermore, the combustion air of the main burner is provided with different air speed components; in particular, the axial air speed component is smaller than that of the main burner, whereby the retention time of the fuel dust particles in the ignition region is increased, thereby improving the ignition stability. In contrast, the tangential air speed component, which is adjustable by the twist blade ring or impeller 5, is greater than that of the main burner in order thereby to assure that the resulting combustion air speed vector, which predominantly influences the turbulence or the mixing procedure, is always maintained in an optimum range.

Additionally, the manner of operation of the ignition burner in special cases can differ from that of the main burner thereby that the ignition burner is operated with a fuel dust which differs in consistency and/or granular size from that of the main fuel if this is necessary for a reliable ignition and ignition stability.

The main burner, aside from a core-air tube 1 with a controllable air supply 8, also comprises a coaxially arranged dust-laden-air tube 9 which is connected with a dust-distributing chamber 10 on the dust conduit 11. A mantle-air tube 12 is arranged coaxially around the dust-laden air tube 9; the mantle-air tube 12 is connected by flaps or deflectors 13 with the main-air passage 14. A twist blade ring or impeller 15, through which the mantle air flows axially, can be axially shifted by means of several spindles 16 and the crank or hand wheel 17. The mantle-air passage 18 is connected with the combustion chamber by means of the conically expanding main burner outlet or discharge 7. The twist blade ring or impeller 15 and the conical burner discharge 7 assure the formation of a back flow zone which enhances the ignition of the main burner. The main burner discharge 7 is made, for example, of a ceramic mass, and is installed in a tubular basket 19 which is formed from the tubes of the wall tubing of the combustion chamber.

The present invention is, of course, in no way restricted to the specific disclosure of the specification and drawing, but also encompasses any modifications within the scope of the appended claims.

What we claim is:

1. A burner, for combustion of powdered fuels, comprising: a main burner, including:

a core-air tube;

a dust tube surrounding at least a portion of said core-air tube;

a first mantle-air tube which surrounds at least a portion of said dust tube and is provided with an air inlet and a burner opening or discharge which widens conically toward a combustion chamber; and a first twist blade ring, which is arranged at said air inlet of said first mantle-air tube and is axially displaceable; and a dust-ignition burner, as an ignition device, concentrically arranged in said core-air tube and including:

an igniter;

an ignition-dust tube arranged concentrically around at least a portion of said igniter;

a second mantle-air tube, which surrounds at least a portion of said ignition-dust tube, for the ignition-dust flame, and second mantle-air tube being provided with an air inlet and discharge which widens conically outwardly; and a second twist blade ring, which is arranged at said air inlet of said second mantle-air tube and is axially displaceable.

2. A burner according to claim 1, in which the conical angle of said second mantle-air tube discharge is at least equal to the conical angle of said first mantle-air tube discharge.

3. A burner according to claim 2, in which said second mantle-air tube discharge terminates prior to the beginning of said conical widening of said first mantle-air tube discharge.

4. A burner according to claim 3, in which said igniter is operated gas-electrically.

5. A burner according to claim 3, in which said igniter is operated oil-electrically.

6. A burner according to claim 3, in which said igniter is operated strictly electrically.

7. A burner according to claim 3, in which said main burner includes a main-air conduit, and which includes separate air lines, having air-control deflectors, for said first and second mantle-air tubes, both of said air lines being in communication with said main-air conduit.

8. A burner according to claim 7, in which said second mantle-air tube forms with said core-air tube the core-air passage for said main burner.

9. A burner according to claim 8, in which the ratio of axial length of discharge cone to corresponding mantle-air diameter is greater for said dust-ignition burner than for said main burner.

10. A burner according to claim 9, in which said ratio for said dust-ignition burner is 0.75 to 1.5, and said ratio for said main burner is 0.4.

* * * * *